United States Patent [19]

Nelson et al.

[11] 4,242,078

[45] Dec. 30, 1980

[54] CENTRALIZED AUTOMATIC PILOT/PILOTLESS IGNITION CONTROL SYSTEM

[76] Inventors: Hollis E. Nelson, 138 Kilmer Ave., Campbell, Calif. 95008; Donald G. Seely, 416 Tryon St., Burlington, N.C. 27215

[21] Appl. No.: 878,785

[22] Filed: Feb. 17, 1978

Related U.S. Application Data

[63] Continuation-in-part of Ser. No. 693,375, Jun. 7, 1976, abandoned.

[51] Int. Cl.[3] ..... F23Q 9/08; F23Q 7/12; H02J 7/00

[52] U.S. Cl. ..... 431/45; 431/47; 431/255; 431/256; 431/257; 307/66

[58] Field of Search ..... 431/46, 45, 47, 71, 431/255, 256, 257; 236/78; 307/66

[56] References Cited

U.S. PATENT DOCUMENTS

| | | | |
|---|---|---|---|
| 2,390,172 | 12/1945 | Ray | 431/46 |
| 3,136,355 | 6/1964 | Weber | 431/255 |
| 3,338,288 | 8/1967 | Walker | 431/71 |
| 3,395,968 | 8/1968 | Mobarry et al. | 431/45 |
| 3,574,496 | 4/1971 | Hewitt | 431/71 |
| 3,596,106 | 7/1971 | Raddi | 307/66 |
| 3,644,074 | 2/1972 | Cade | 431/46 |
| 3,822,039 | 7/1974 | Mori et al. | 236/78 |
| 3,938,935 | 2/1976 | Engelbert | 431/47 |

FOREIGN PATENT DOCUMENTS

| | | | |
|---|---|---|---|
| 1202197 | 7/1959 | France | 431/46 |

*Primary Examiner*—Samuel Scott
*Assistant Examiner*—Wesley S. Ratliff, Jr.
*Attorney, Agent, or Firm*—John J. Leavitt

[57] ABSTRACT

An automatic ignition control system for controlling the pilot burners and main burners of fuel burning appliances so that these burners are ignited only upon demand is disclosed. The system consists of a main control unit which may be interconnected with conventional main and pilot burners or which may be connected with a new and novel burner specifically designed for the purpose. The main control unit is actuated by suitable thermostats or switches when burner operation is required and operates to open the pilot valve and activate a pilot igniter control circuit. The igniter control circuit may take several forms, depending upon the type of igniter used with the burner, and sensing means are provided to deactivate this igniter control circuit when a pilot flame is detected. If the pilot fails to ignite after a predetermined period of time, the main control deactivates the pilot solenoid and sounds an alarm. After ignition of the pilot, the main control unit activates the main burner valve and allows the main burner to be turned on. At the end of the burner usage, both the main and pilot valves are turned off, thereby conserving the fuel that is usually wasted through a continuously burning pilot burner.

23 Claims, 9 Drawing Figures

CENTRALIZED AUTOMATIC PILOT/PILOTLESS IGNITION CONTROL SYSTEM

BACKGROUND OF THE INVENTION

The present application is a continuation-in-part of our copending application Ser. No. 693,375, filed June 7, 1976, now abandoned.

This invention relates to gas or oil fuel heating systems and more particularly to the automatic ignition of fuel only upon the demand for heat under the control of a temperature sensing device, a manually operated switch, or other suitable control elements.

There was a time when there appeared to be no reason for concern about the preservation of our natural resources, for those resources appeared to be virtually limitless. That is no longer true. Our society has come to the realization that unless an effort is made to conserve, many of the resources upon which we now depend will become exhausted, some within our life time. It thus behooves society to take advantage of every opportunity to preserve those resources. In recent years this country has been plagued by a shortage of petroleum based products. One such product that has been in short supply is heating oil, derived from petroleum; another such product that has been in short supply is natural gas of the type used for heating our homes and for domestic purposes such as cooking, and used also in large quantities in industry. Accordingly, it is one of the objects of the present invention to provide a system for the control and ignition of gas and oil burning devices so as to conserve millions of cubic feet of such natural resources, and, as a consequence, save millions of dollars in costs for the users of such products.

One of the greatest sources of waste of natural gas and liquid petroleum gases has been the almost universal practice of requiring appliances that use these fuels to maintain burning at all times a pilot burner flame operatively associated with the main burners so that when the main burners are turned on, they will be immediately ignited by the pilot burner flame. The justification for this practice has been that, in the event of a gas leak through a main burner or pilot burner valve, the presence of such a pilot flame would insure that the leaking gas would ignite and thus prevent the collection of a large volume of gas with the consequent danger of explosion. Modern technology has, to a large extent, eliminated the possibility of such leaking main and pilot burner valves, and it is therefore necessary to evaluate whether the risk of a leaking pilot or main burner valve outweighs the need to conserve such fuel as is unnecessarily burned by the pilot burners in modern-day appliances. Accordingly, it is another object of the invention to provide apparatus and a method of its operation which will eliminate the ever-burning pilot burner as we know it today while providing fail-safe features to insure that gas and oil burning appliances will operate safely.

It is presently possible to purchase appliances that utilize gas or oil that do not utilize a pilot burner and in which the gas or oil fuel is ignited at the time that a demand is made for use of the equipment. The conventional natural gas clothes dryer is such an appliance. In this appliance, a glow coil is connected to the 110 volt power source and is energized when the gas is turned on to activate the appliance. One of the problems with such an appliance is that it must be connected directly to a substantial power source and will, of course, be inoperative if there is an interruption in the power source. While the inability to dry one's clothes in a gas-fired clothes dryer might not be a hardship, it is easy to understand that if such an igniter is utilized in other types of appliances such as water heaters, furnaces and cook stoves, a power outage could result in dire consequences. Accordingly, it is another object of the present invention to provide a centralized automatic pilot ignition control system and apparatus in which individual igniters are utilized in separate appliances but the control for such igniters is centralized so as to increase the reliability and decrease the cost of the system.

It is common knowledge that in appliances that utilize a pilot burner, the pilot burner is maintained on, i.e., burning a flame during the time that the main burner flame is off. It has been found that this practice is wasteful of fuel and has been categorized as an "idling" burner in that it really does not perform any useful function during this interval. Accordingly, another object of this invention is to provide an automatic pilot ignition control system and apparatus in which the pilot burner is initially ignited only upon demand so as to ignite the main burner associated therewith, and then the pilot burner is extinguished when the main burner goes off so as to conserve the fuel that would otherwise be burned while the pilot burner was uselessly "idling".

Another object of the invention is to provide an automatic pilot ignition system and apparatus which is applicable to new appliances and which is just as applicable to retrofit existing gas or oil fired equipment, thus providing the means by which immediate action may be taken to conserve fuel otherwise wasted.

It is useful to keep in mind in connection with a discussion of appliances the fact that some appliances utilize a pilot burner that is initially ignited prior to ignition of a main burner associated with it, while other appliances utilize the concept of direct ignition of the main burner. It has been found in connection with these two types of operation that appliances utilizing the pilot burner posses some advantages not possessed by the so-called "pilotless" burners. Such advantages include electromechanical fail-safe devices readily available in the retrofit market; a safer manual restart should there be an electrical power outage; and a lesser danger in igniting the large volume of gas which occurs when the main burner valve is opened. Nevertheless, direct ignition of main burners through automatic igniters do exist on a number of appliances. Accordingly, it is another object of this invention to provide an automatic ignition control system and apparatus for gas and oil burners which is applicable to both the pilot and pilotless type of appliances.

With the advent of pilotless ignition systems for some appliances, it has been found that the tendency of this technology is to incorporate all electronics and igniters within the body of the fuel metering control valve associated with the appliance. Such a construction is illustrated in U.S. Pat. Nos. 3,191,661 and 2,733,759. Analysis indicates, however, that the incorporation of the electronics and igniters in the fuel metering control valve increases the cost of manufacture of such valves initially, and renders the replacement of the existing appliance valves with the newer type prohibitively expensive. Accordingly, another object of this invention is the provision of a centralized automatic pilot or pilotless ignition control system and valve assembly in which the cost of each valve is significantly reduced through centralization of the control electronics so that a single control console may be applied to control a multiplicity of relatively simple and inexpensive valves in separate appliances.

As indicated above, one of the dangers of utilizing a direct ignition main burner is the necessity of connecting the igniter for such burner to a substantial source of power. Accordingly, another object of the present invention is to provide a centralized automatic ignition control system for gas and oil burners that utilizes a nominal 12 volt DC power source which for practical purposes may constitute a rechargeable battery connected to a conventional source of power so that the battery is maintained at full charge and may be operated as a backup power supply should the conventional commercial power supply fail.

It is necessary to keep in mind in the design of a centralized automatic pilot ignition control system for gas and oil burning appliances that the system be designed for maximum reliability and convenience of operation. In this regard, it is an object of the present invention to provide a control system for automatic ignition of fuel burning appliances that utilizes solid state components that have withstood the test of time in many different environments and which are included in the system in a centralized location that is remote from the appliance that it controls.

Another object of the invention is the provision of a centralized ignition control system that incorporates the versatility required to arbitrarily and selectively eliminate one or more appliances from the control system by the mere expedient of throwing a switch, while maintaining the control system operational in so far as all other appliances are concerned.

Another object of the invention is to provide a control system for appliances in which the entire system may be shut down so that all appliances will be effectively rendered nonoperational at the discretion of the homeowner. Such a condition might exist for instance when a house is closed down for vacation, or when a vacation home is closed down during a period of nonuse.

Because most homeowners and operators of fuel burning appliances are not electronic engineers, it is expedient that any control system for such appliances be simple in its operation, easily understood as to the functions which it performs, and that it incorporate means for manually overriding the control system in the event the control system fails, or in the event the homeowner arbitrarily decides that he wants to manually operate the appliances connected to the system. Accordingly, another object of the present invention is the provision of such a control system that incorporates manual override means whereby any of the appliances connected to the system may be ignited manually by the operator or homeowner.

Concomitantly, it is advisable in such a system that some form of alarm be provided to alert the homeowner that a malfunction has occurred in the system. Accordingly, another object of the invention is to provide a centralized automatic ignition control system for gas and oil burning appliances that energizes such an alarm when a malfunction occurs.

The adoption of new control mechanisms is sometimes hampered by a lack of understanding of the person that is required to use them or for whose benefit the control system is provided. Accordingly, it is another object of the present invention to provide a centralized automatic ignition control system for fuel burning appliances that utilizes the conventional thermostat or electronic temperature sensor for initiating the operation of the control circuitry, thus providing the homeowner or operator of the appliances with an element that he is familiar with so as to eliminate resistance to adoption of the control system.

Although modern technology has rendered the failure of pilot burners almost non-existent, such pilot burners or the pilot generators associated therewith do fail from time to time. In a conventional appliance equipped with a pilot burner and a pilot generator that incorporates a thermocouple heated by the pilot burner to generate an electric current to assist in opening the main valve of the main burner, the lack of a signal from the pilot generator, or a malfunction in the thermostat that receives the signal from the pilot generator, will prevent opening of the main valve so that the main burner will not come on. Accordingly, it is an object of the present invention to provide a control system for such appliances that will activate an alarm circuit under these circumstances so as to alert the homeowner of the particular appliance that is defective so that remedial action may be taken promptly.

As discussed above, with automatic igniters that are connected to a commercial power source for direct ignition of main burners, there is an electrical shock hazard associated with such appliances because of the relatively high level of power required. Accordingly, it is another object of the present invention to provide a control system for controlling and igniting the burners in fuel burning appliances that utilizes solid state electronics, thus minimizing the voltage and current demands for the system and minimizing the electrical shock hazard associated therewith.

In this connection, another object of the present invention is to provide a control system in which ignition of a pilot burner is accomplished by a solenoid-operated piezoelectric crystal mounted in the gas metering control valve.

A still further object of the invention is the provision of a centralized automatic ignition control system which will shut down completely in the event of a total interruption of gas service and which will automatically reinstate all control circuits upon restoration of such gas service.

The invention possesses other objects and features of advantages, some of which the foregoing, will be apparent from the following description and the drawings. It is to be understood, however, that the invention is not limited to the embodiment illustrated and described, since it may be embodied in various forms within the scope of the appended claims.

SUMMARY OF THE INVENTION

In terms of broad inclusion, the centralized automatic pilot/pilotless ignition control system of the invention comprises a main control circuit which may be arranged in a separate control panel connected to a commercial source of power but which preferably has as an alternate source of power a battery-operated power supply. The control panel is connected to operate the pilot and the main burner gas or oil metering control valves which are associated with one or more separate appliances utilizing such control valves, and is further operatively associated with the pilot and/or main burners per se, through the use of thermocouples at the pilot or main burners for generating an electric current when these elements are operative.

The main control circuit is responsive to demand sensors such as thermostats, manually activated switches, or the like, and operates to activate a suitable igniter control circuit. This latter circuit may be in the form of a pulse generator for activating a piezoelectric igniter, may be in the form of a multivibrator for producing a series of ignition sparks, or the like, depending upon the nature of the burner which is to be controlled. The burner itself may be a standard unit, with the main control circuitry serving as a replacement for the existing control circuitry, thereby converting existing units which require a continuous pilot to "pilotless" operation wherein the pilot is off during times of nonuse. In a preferred form of the invention, the system utilizes a new and unique valve structure which cooperates with the main control circuit to provide a complete burner system. The system incorporates both electronic and mechanical fail-safe devices to render the system acceptable where local, state or federal law requires such devices. Thus, by the provision of a novel gas metering device operable in conjunction with a control system which includes a master control circuit operating in cooperation with an igniter control circuit and temperature sensing circuits, or by the provision of such a control system for use with existing gas metering devices, the disadvantages of prior art systems are overcome.

BRIEF DESCRIPTION OF THE DRAWINGS

The foregoing and additional objects, features and advantages of the invention will become apparent to those of skill in the art from a consideration of a detailed description thereof, taken in conjunction with the accompanying drawings, in which.

DETAILED DESCRIPTION OF THE INVENTION

Figure 1:
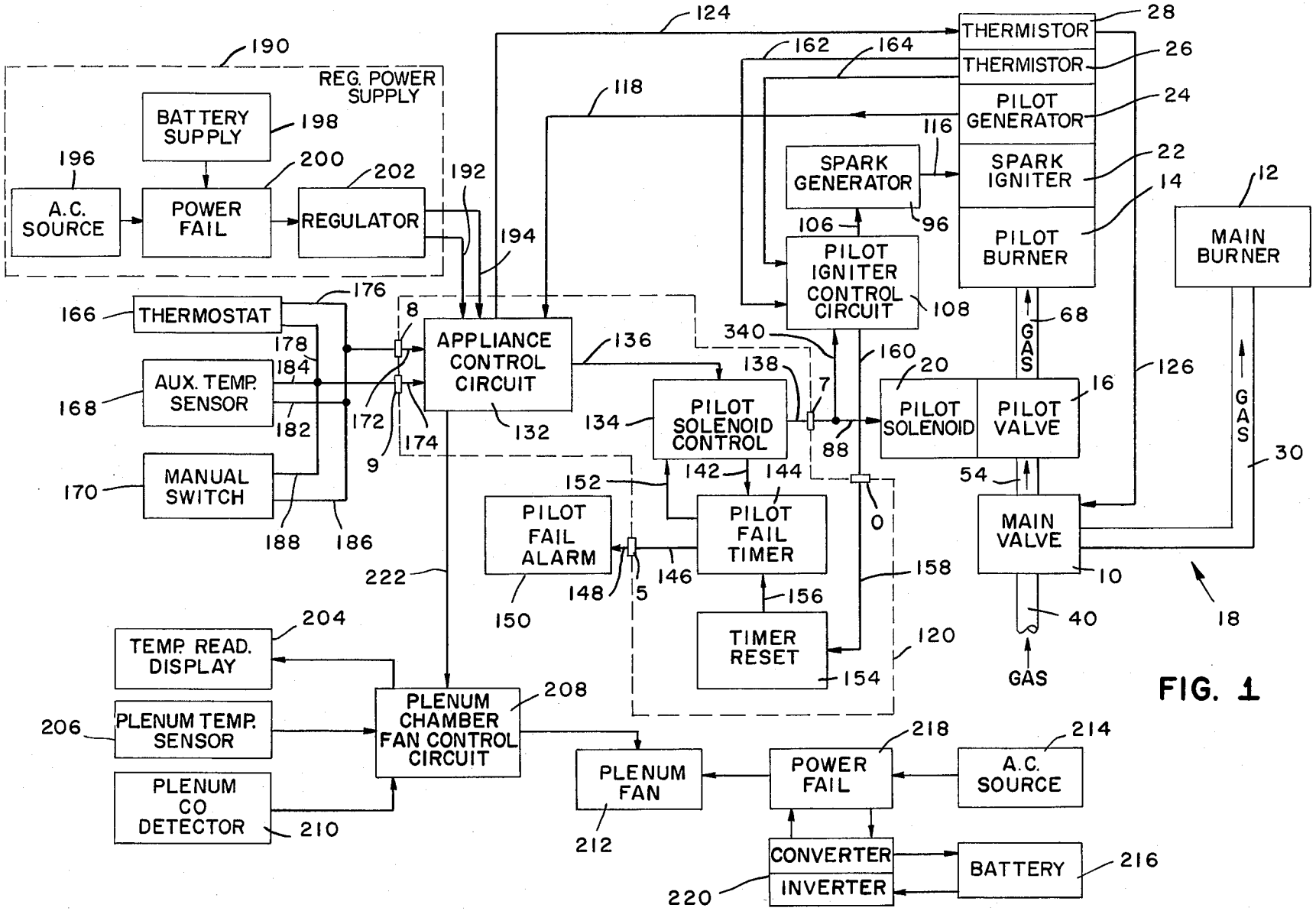
FIG. 1 is a block diagram illustrating the control system of the invention.

Turning now to a more detailed consideration of the invention, there is illustrated in FIG. 1 in block diagram form the centralized automatic pilot/pilotless ignition control system of the invention. As shown, the system comprises a main fuel valve designated generally by the numeral 10 associated with a main burner 12 and also associated with a pilot burner 14 and a corresponding pilot valve 16. Although for convenience the valves and burners disclosed herein will be described in terms of a gaseous fuel such as natural gas, it will be understood that this is for purposes of illustration and simplicity of description, and that the inventive concepts herein are equally applicable to other types of fuel burners. Cooperating with, and operatively associated with, the gas valve structure, which is generally indicated by the numeral 18, are suitable control elements such as a pilot solenoid 20 which may be activated to operate the pilot valve 16, a spark igniter 22 which is located adjacent the pilot burner and serves to produce the required spark for igniting the pilot, and a pilot generator 24, again located adjacent the pilot burner and operative to produce an output voltage indicative of the presence of a flame at the pilot burner. Also associated with the burner 14 may be a pair of sensing thermistors 26 and 28 which are used for control functions to be described.

Figure 2A:
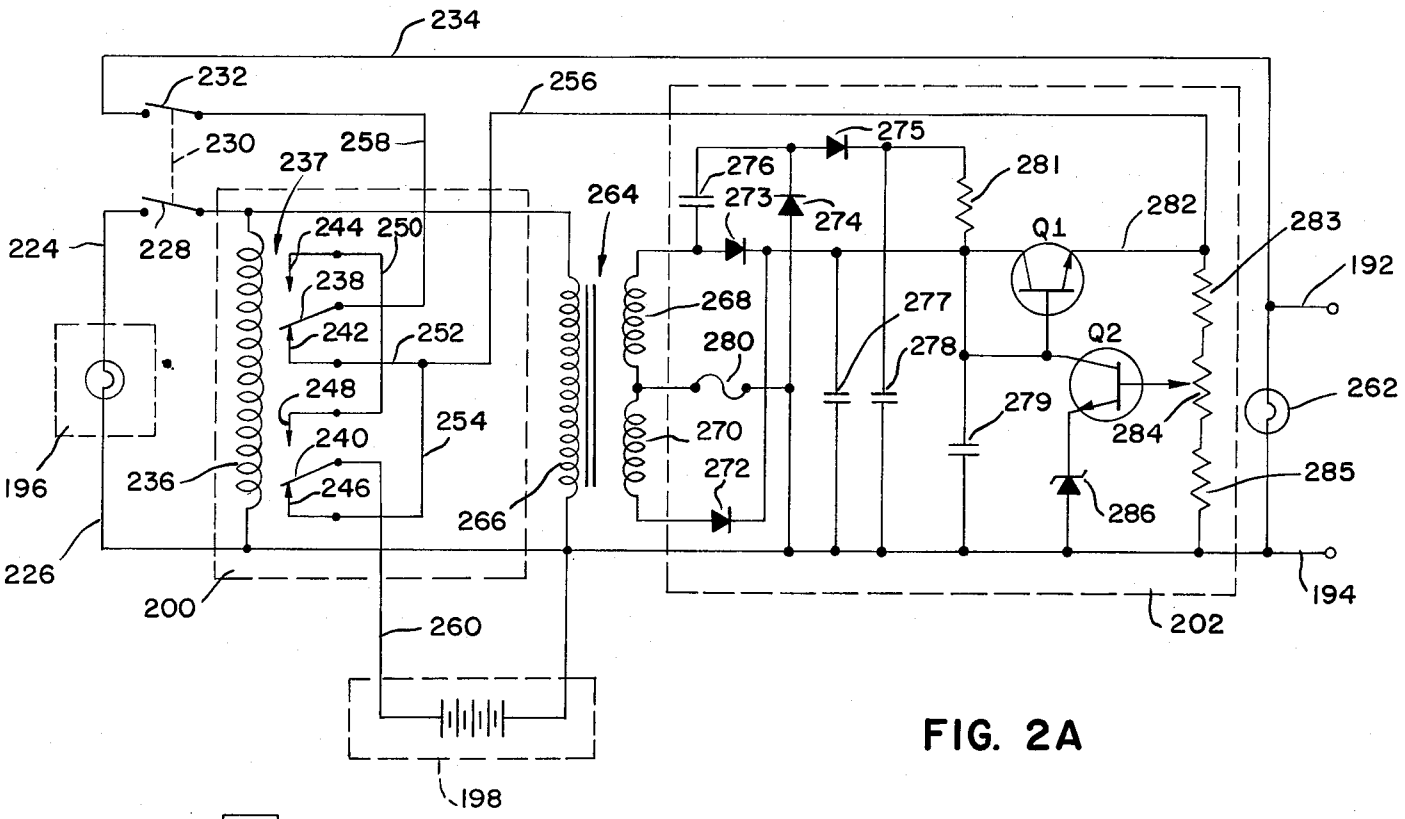
FIGS. 2A, 2B, 2C, and 2D are a schematic diagram of a portion of the block diagram of FIG. 1, illustrating in detail the power supply, main control panel and igniter circuits and the valve structure used with such circuitry.
Figure 3:
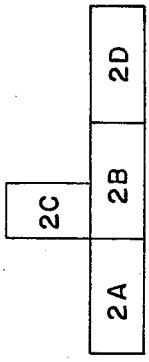
FIG. 3 illustrates the relationship of FIG. 2A through 2D.
Figure 2B:
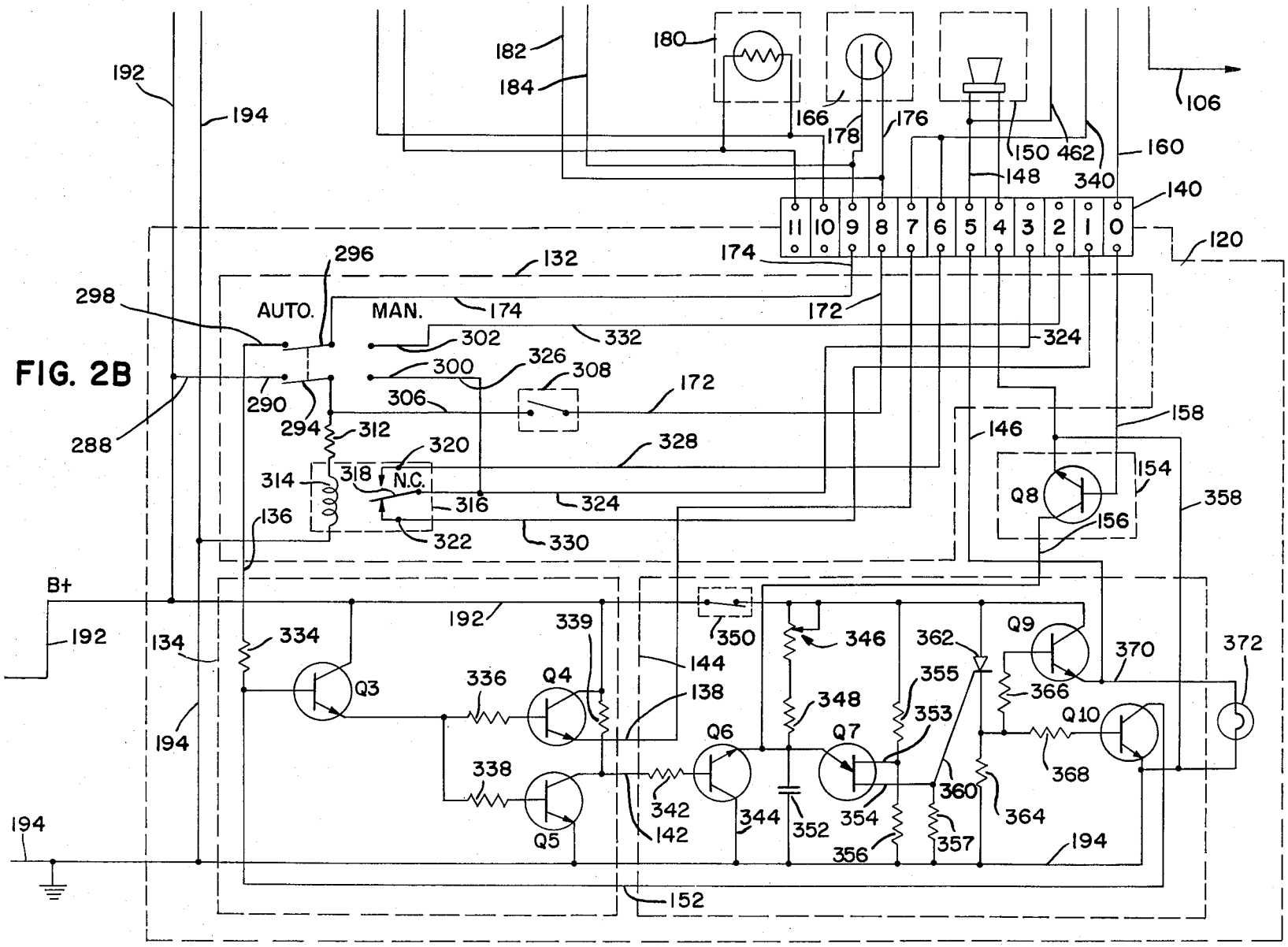
Figure 2C:
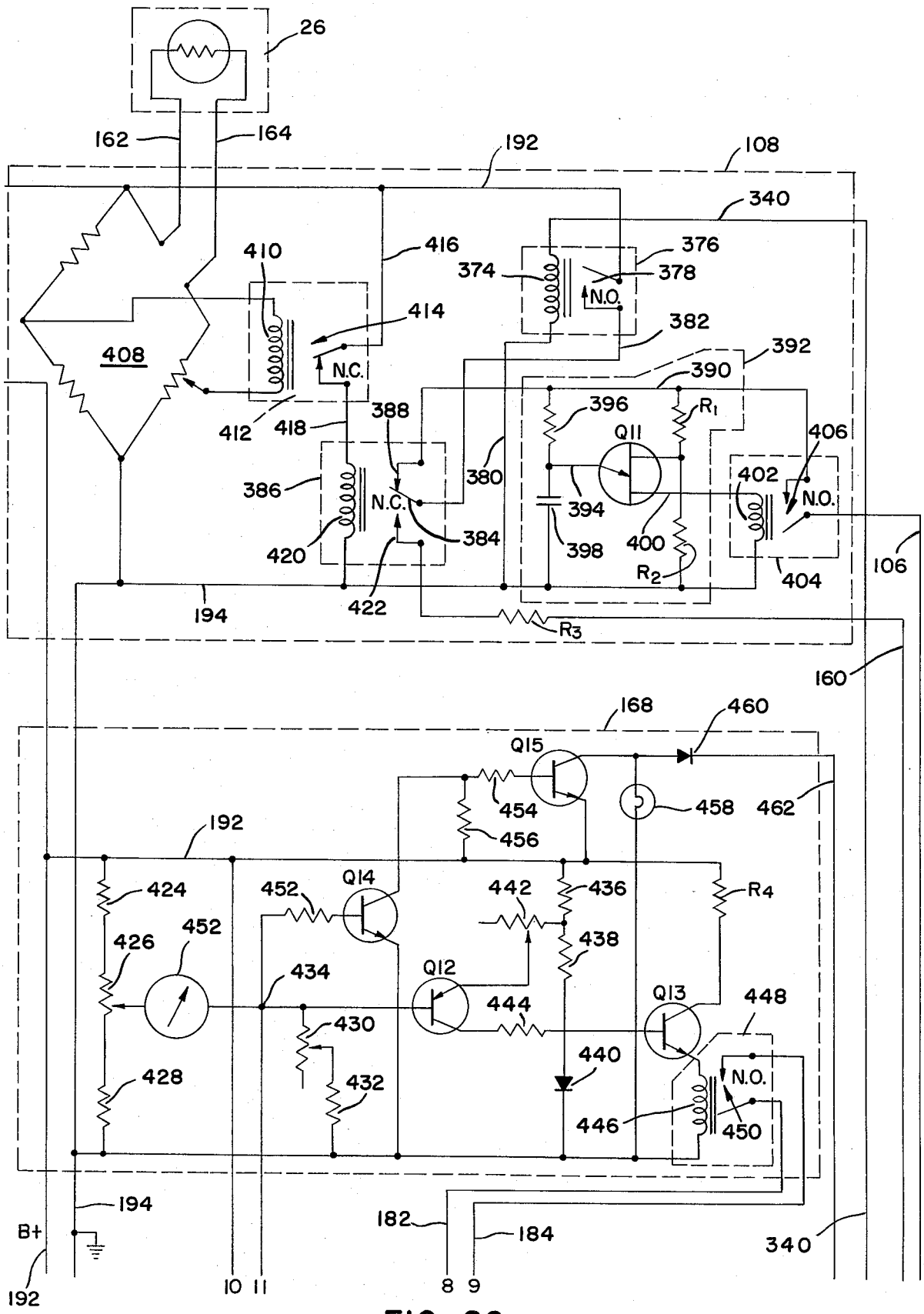
Figure 2D:
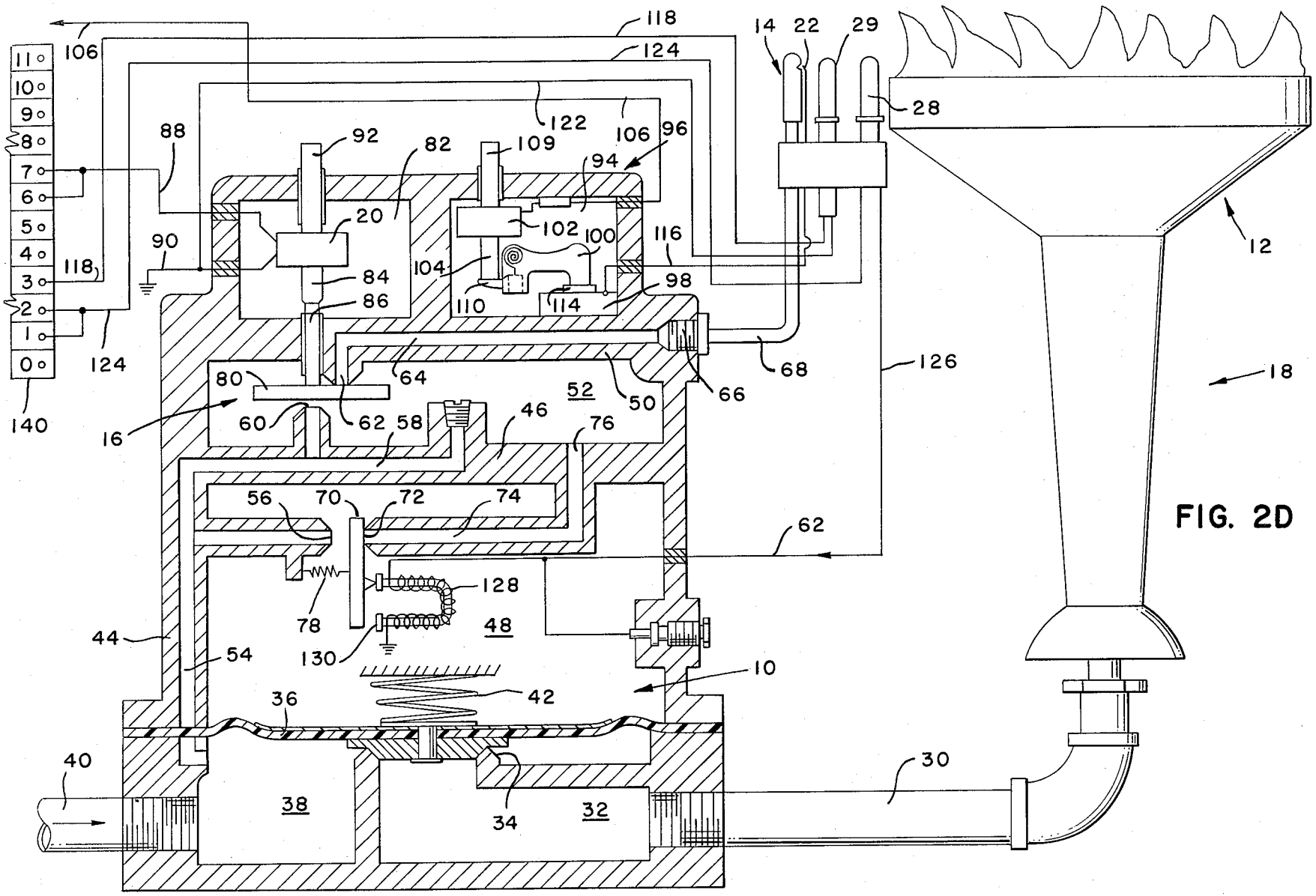
Figure 6:
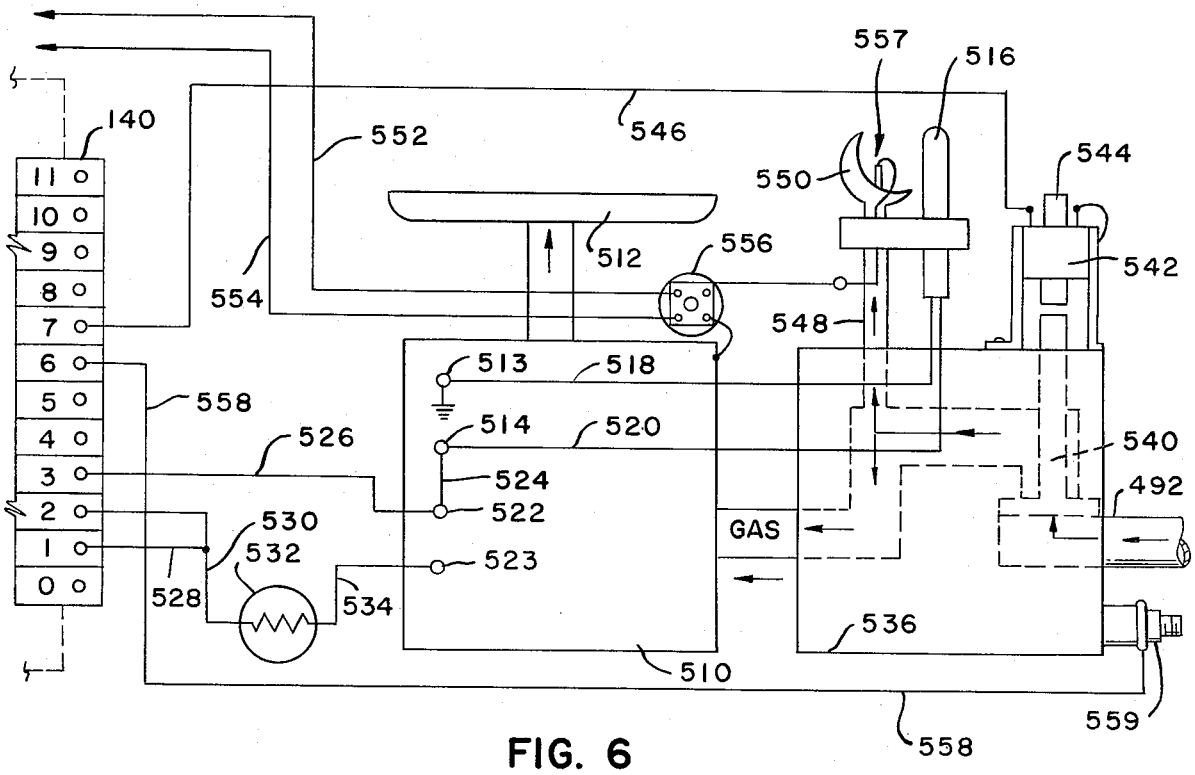
FIG. 6 is a diagrammatic illustration of a second form of conventional control valve and which utilizes the multivibrator source of FIG. 5 in conjunction with the control circuitry of FIG. 2.

Although the valve structure 18 may be any conventional gas valve, in a preferred form of the invention the valve illustrated in FIG. 2D is used since it combines the function of the two valves shown in FIGS. 4 & 6, and for convenience of reference in describing the operation of the control circuitry, that valve structure will first be described. Referring now to FIG. 2D, therefore, the main burner 12 is illustrated as being connected through an appropriate conduit 30 to an outlet chamber 32 forming a part of the main valve structure 10. Outlet chamber 32 is connected through a valve port 34, controlled by a transversely extending diaphragm valve 36, to an inlet chamber 38 connected to a gas supply main 40. The diaphragm valve 36 is normally seated on the port 34 to prevent the flow of gas from the inlet chamber 38 to the outlet chamber 32 unless the valve 36 is lifted against the pressure of a biasing spring 42 which serves to normally hold port 34 closed.

The outlet and inlet chambers 32 and 38 may be formed in a housing defined by sidewall 44, the sidewall preferably being cylindrical in cross section. Extending transversely across the housing is a wall 46 which divides the housing into upper and lower portions, the lower portion between the wall 46 and the diaphragm valve defining a pressure chamber 48. The upper portion of the housing, between wall 46 and a top wall 50 of the housing, defines a pilot valve chamber 52.

As illustrated in FIG. 2D, the inlet chamber 38 communicates with the pressure chamber 48 through a passageway 54 having a port 56 therein. The inlet chamber also communicates through passageway 54 and a lateral extension thereof, indicated at 58, with the pilot valve chamber 52, by way of port 60. The port 60 is adapted to be opened or closed in a manner which will hereinafter be explained. The pilot valve chamber 52 is, in turn, connected by way of a port 62 and a passageway 64 in the top wall 50 of the housing to an appropriate fitting 66 in the sidewall 44 of the valve housing, the fitting forming an appropriate connection for a conduit 68 extending between the valve housing and the pilot burner 14.

Mounted without the pressure chamber 48 is an electrically operated valve plate 70 positioned to move between the port 56 and an adjacent port 72 which forms one end of a passageway 74 which extends between the pressure chamber 48 and the pilot valve chamber 52, the opposite end of passageway 74 opening in a port 76. The plate valve 70 is normally spring-biased by a suitable spring 78 to retain the valve plate against the port 72, thus closing this port while opening port 56 and permitting gas to flow from the inlet chamber through the bypass 54 and into the pressure chamber 48. The gas pressure in the pressure chamber 48 thus normally retains the main gas valve 36 in a closed position as illustrated.

The pilot valve 16 is located in the pilot valve chamber 52, and consists of a second plate valve 80 which is movable between the ports 60 and 62. Thus, in the position illustrated in FIG. 2D, the plate valve 80 holds port 62 closed so that gas cannot flow to the pilot burner. When the plate valve 80 is activated to shift its position and to close port 60, port 62 is opened to permit gas to flow from the pilot valve chamber to the passageway 64 and conduit 68 to the pilot burner.

To control the operation of the plate valve 80, there is provided a pilot solenoid coil 20 mounted in a chamber 82 formed on the valve housing, the solenoid coil 20 working in conjunction with an armature 84 connected to a drive shaft 86 on which is mounted the plate valve 80, whereby activation of the solenoid coil effects transfer of the plate valve between the ports 60 and 62. The solenoid coil 20 is activated through appropriate electrical leads 88 and 90 leading to the control circuit to be described, and the armature 84 is retained in a retracted position, as illustrated, by an appropriate spring which, for purposes of clarity, has been omitted from this illustration. The armature 84 is also connected to a push button 92 which extends through the upper wall of chamber 82 to permit manual depression of the plate valve 80 under appropriate conditions, as will hereinafter be explained.

Also mounted on the upper portion of the valve housing, preferably in a closed chamber 94, is a spark generator 96 which, in this embodiment, consists of a piezoelectric crystal 98 adapted to be struck by a hammer 100 mounted for pivotal motion in the chamber. The hammer is actuated by a solenoid coil 102 and an associated armature 104, the armature being mounted in the chamber and adapted to drive hammer 100. The solenoid coil 102 is activated through electrical lead 106 by a pilot igniter control circuit 108 (FIG. 1) which will be described in detail hereinbelow. Hammer 100 may also be manually actuated by means of a push button or plunger 109 extending through the upper wall of chamber 94.

The interconnection between the armature 104 of the solenoid and the hammer 100 is through an extension 110 on the hammer, the extension serving as a lever arm for pivotally driving the hammer into a cocked position, the hammer being spring-biased in such a way that energization of the solenoid or depression of plunger 109 cocks the hammer and thereafter causes it to be released so that the head portion 114 strikes the piezoelectric crystal to generate a current. This current is fed by way of an output line 116 to the spark igniter 22 which is located adjacent pilot burner 14, as illustrated in FIG. 2D. Thus, upon striking of the hammerhead 114 on the piezoelectric crystal, an arc is struck at igniter 22, thereby igniting any gas eminating from the pilot burner by reason of the opening of pilot valve 16.

Once the pilot burner has ignited, the heat from the pilot flame heats the pilot generator in the usual manner, producing a current in lead line 118 which is connected to the main control circuit 120 (FIG. 1) to be described, thereby indicating to the control circuit that the pilot has ignited, enabling the control circuit to produce an output on line 124 which passes through thermistor 28 and line 126 to open the main valve 10. The thermistor 28, which is also responsive to the pilot flame, serves as a safety switch in that it will not permit a flow of current in line 126 sufficient to open the main valve unless the pilot burner is on.

The current in line 126 is fed to a solenoid coil 128 which is wound around and which energizes its core 130 located in the pressure chamber 48. Energization of core 130 exerts a magnetic pull on the plate valve 70, causing it to move against the pressure of bias spring 78 to open port 72 and close port 56. As soon as this occurs, gas from inlet chamber 38 can no longer flow through passageway 54 into the pressure chamber 48, while the opening of port 72 allows the gas already in chamber 48 to flow outwardly through the outlet passage 74 into the pilot valve chamber 52. Since at this time the pilot valve 16 has already been actuated, the gas from the pressure chamber 48 is permitted to flow through port 62 and conduit 64 to the pilot burner 14, thereby releasing the pressure in chamber 48. As a result, the gas pressure in inlet chamber 38 becomes sufficiently greater than the pressure in chamber 48 to overcome the bias of spring 42 to raise the diaphragm valve 36 and thus open the port 34 to permit gas to flow through the outlet chamber 32 and conduit 30 to the main burner 12. The gas flowing to the main burner is then ignited by the pilot burner 14.

It will be understood that the usual operation of the valve illustrated in FIG. 2D will be under the control of the main control circuit 120 in response to operation of a thermostat or other demand sensor. However, the valve may be manually operated by depressing the plunger 92 to open the pilot valve 16, thereby allowing gas to flow through port 62 and conduit 64 to the pilot burner 14. Simultaneously, the plunger 110 is manually depressed to cause the hammer 100 to strike the piezoelectric crystal 98 and to thereby produce an arc at the spark igniter 22. Upon occurrence of a flame at the pilot burner 14, the generator 24 would produce a current that would hold the pilot valve open and which would, upon demand by a thermostat, open the main valve and ignite the main burner.

Returning now to the block diagram of FIG. 1, the main control circuit 120 is illustrated as including an appliance control circuit 132 which provides the interconnections between the demand sensors and the remainder of the control circuitry and which permits selection of automatic or manual control of the burner. This circuit activates the pilot solenoid control circuit 134 by way of control line 136. The output of the solenoid control circuit 134 is connected by way of line 138 through connection point 7 on a terminal board 140 and thence by way of line 88 to the pilot solenoid 20 (FIG. 2D). The terminal board 140 is illustrated in greater detail in FIG. 2B, which shows the schematic diagram of the main control circuit 120. As illustrated there, the terminal board provides a convenient connection point between the main control circuitry and the various peripheral circuits to which it is connected. It will be noted that in order to clarify the drawings, and to simplify the manner in which the various burner and valve structures may be interconnected with the control circuitry, the connections between valve 18 and the main control 120 are illustrated in FIG. 2D by a partial illustration of the circuit board 140, it being understood that the connections shown in FIG. 2D are in addition to those shown in FIG. 2B.

Returning to FIG. 1, activation of the solenoid control circuit 134 to operate the pilot valve 16 also results in an output signal on line 142 to initiate a pilot fail timer circuit 144 which limits the amount of time that solenoid 20 can be held activated in the absence of a pilot flame. If the pilot is not ignited within the period set by timer 144, an output signal is produced on line 146 which is applied through terminal connection 5 and line 148 to a pilot fail alarm 150. At the same time, an output from timer 144 is applied by way of line 152 back to the pilot solenoid control circuit 134 to turn it off and deactivate the pilot valve 16, thus providing a safety feature which prevents the pilot valve from remaining open for an unsafe period of time.

The timer 144 is reset upon ignition of the pilot burner by means of a reset circuit 154 in the main control circuit 120. The reset circuit turns off the pilot timer 144 by means of a signal applied by way of line 156 upon receipt of a signal from the pilot igniter control circuit 108 by way of line 158, terminal connector 0 and line 160. The igniter control circuit produces a reset signal on line 160 in response to signals from thermistor 26 by way of lines 162, 164 indicating that the pilot has been ignited.

The demand sensors, which provide indications that heat from the main burner 12 is required, may take the form of a conventional thermostat 166, of the type generally used for furnaces or the like, or an auxiliary temperature sensor 168, of the type generally used for hot water heaters or the like, or may be in the form of a manual switch 170 such as may be provided on a gas-operated range or oven. Each of these sensors may be connected to the appliance control circuit 132 by way of terminals 8 and 9 and corresponding leads 172, 174. As illustrated in FIGS. 2B and 2C, the thermostat 166 may be a conventional bimetallic switch device connected across terminals 8 and 9 by way of leads 176 and 178. The auxiliary sensor 168 may take the form of a bridge circuit having as one leg thereof a temperature sensitive resistor device 180, with the output of the bridge being connected by way of lines 182 and 184 to terminals 8 and 9. Switch 170 may simply be a manually operated on-off switch connected by way of lines 186 and 188 to terminals 8 and 9 in parallel with the thermostat and the temperature sensor.

A suitable regulated power supply 190 supplies power to the main control circuit 120 and to the associated elements of the system by way of lines 192, 194, regulated power being supplied either from an AC source 196 or a suitable emergency battery supply 198 through a power fail network 200 and a regulator 202 to be described in detail below.

Where the gas burner 18 is incorporated in a furnace structure, it is important to provide control of the functions that are performed by the furnace as well as control of the burner itself, so that if a malfunction occurs the system will either be shut down completely, or an audible or visual alarm will be activated so that the homeowner is aware of the malfunction. To this end, therefore, the system may provide a temperature readout display 204 which is operated by a temperature sensor device 206 preferably located in the furnace plenum. The temperature sensor also provides an input to a plenum chamber fan control circuit 208 which also receives an input from a plenum carbon monoxide detector 210. The fan control circuit 208 is responsive to the temperature sensor and the CO detector to operate the conventional furnace plenum fan 212. For the ultimate protection of the homeowner, the plenum chamber fan 212 is connected through appropriate conductors to a suitable power supply which includes an AC source 214, an emergency battery source 216, and a suitable power failure circuit 218 which selects either the AC source or the battery source for supplying power to the fan 212. The power fail circuit 218 is connected to the battery 216 through a suitable converter-/inverter circuit 220 to insure that the battery is maintained at a full charge during the time that the AC source is operative, the battery source serving to insure that the plenum fan will remain operative even in the absence of conventional AC power. The plenum chamber fan control circuit 208 is connected to the regulated power supply 190 by way of the main control circuit 120 and line 222.

While the foregoing has given an overall perspective of the entire system, it is important that the function of each of the separate segments thereof be understood and that there be an understanding of the interrelationship between the separate segments which provides the fail safe operation of the centralized automatic pilot/pilotless ignition control system of the invention.

Referring, therefore, to the more detailed illustration of the preferred form of the invention which is illustrated in FIGS. 2A, 2B, 2C, and 2D, reference will first be made to the power supply which is illustrated in FIG. 2A. The power supply is connected to an AC source 196 which may comprise a conventional 120 volt AC house current. The source is connected by way of leads 224 and 226 to the input of the power fail circuit 200, lead 224 passing first through one contact 228 of a double-pole signal throw on-off switch 230, the other contact 232 of which is connected in the DC output line 234.

The AC power supply to the power fail circuit 200 is applied across a relay coil 236. Associated with this coil is a pair of relay switches 238 and 240 movable between corresponding contacts 242, 244 and 246, 248, respectively. Contacts 244 and 248 are normally closed, but when relay coil 236 is energized, the switches 238 and 240 shift to their respective contacts 242 and 246, as illustrated in FIG. 2A. Contacts 244 and 248 are interconnected by line 250, while contacts 242 and 246 are interconnected by lines 252 and 254, the junction of these latter two lines being connected by way of line 256 to the output of regulator 202, whereby regulated DC voltage is applied by way of line 256, line 252, contact 242, switch 238 and line 258 leading from the power fail network through the on-off switch contact 232 to supply line 234, and thence to power supply output line 192. The DC supply appearing on line 256 is also applied by way of line 254, switch contacts 246 and 240 to a second output line 260 leading from the power fail network to battery 198, whereby a trickle charge is appplied to the battery.

If relay coil 236 should become deenergized by a failure of the AC source, switches 238 and 240 will shift to their normally closed position and close contacts 244 and 248, respectively. Under this condition, line 256 is disconnected from the output line 234 and the battery lead 260 is connected by way of switch 240, contact 248, line 250, contact 244, switch 238 and line 258 to the supply line 234, thus maintaining the DC voltage on the output line. This output line is connected to terminal 192 which supplies the DC current to the remainder of the centralized automatic pilot/pilotless ignition control system of the invention. A lamp 262 is connected between terminal 192 and the ground reference terminal 194, which is connected to the AC source ground line 226, to indicate when the power supply circuit is on.

The DC voltage regulator 202 is supplied by a transformer 264 having a primary winding 266 connected across the AC source by way of on-off switch 230. A pair of secondary windings 268 and 270 feed power to a rectifier circuit which includes diodes 272, 273, 274 and 275, the resulting DC voltage being filtered by suitable capacitors 276, 277, 278, and 279. The center tap of the secondary windings 268, 270 is connected through a fuse 280 to the ground reference line 226.

The output of the rectifier and filter network is supplied from diode 275 through resistor 281 and from diodes 272, 273 across supplied capacitor 277 to the collector of a series regulator transistor Q1, the emitter of which is connected through line 282 to the regulator output line 256. The conductivity of Q1 is controlled by its base bias which is varied by means of regulator transistor Q2, the collector of which is connected directly to the base of Q1. The base bias on Q2 is supplied by means of a potentiometer 284 connected in a voltage divider between line 282 and the ground reference line 226, the divider including resistors 283, 284 and 285. The emitter of Q2 is held at a reference value established by a Zener diode 286. The operation of transistor Q2 varies the conductivity of Q1 to maintain the DC current on output line 256 at a stable, constant value, and this current supplies the output for the regulated power supply as long as the AC source is available. Upon failure of that source, the output of regulator 202 is disconnected and the battery 198 supplies the required voltage to operate the system.

The main control circuit 120 for the system is illustrated in detail in FIG. 2B, to which reference is now made. As there illustrated, the DC regulated power from power supply 190 is supplied to the main control by way of leads 192 and 194, line 192 being the B+ bias source and line 194 comprising the ground reference. The positive supply line 192 is connected by way of input line 288 to a first terminal 290 of a master control switch 292 which is a double pole-double throw switch that may be shifted between automatic and manual positions. In the automatic position, the movable switch blades 294 and 296 are connected to terminals 290 and 298, while in the manual position the switch blades are connected to terminals 300 and 302, respectively.

Switch blade 296 is connected by way of line 174 to terminal 9 of terminal board 140, and thus to the demand sensor for the system which may be thermostat 166, termperature sensor 168, or the like. Switch blade 294, on the other hand, is connected by way of line 306, on-off switch 308, and line 172 to terminal 8 of terminal board 140, to provide the second connection for the thermostat 166 and the sensor 168. Switch blade 294 is also connected through a current limiting resistor 312 and through the energizing coil 314 of relay 316 to ground line 194. If switch blade 294 is in contact with switch contact 290, a positive voltage will be applied through the switch blade 294 to the relay 316, energizing it to shift its movable contact 318 away from the normally closed contact 320 and into engagement with the normally open contact 322. The movable contact is connected by way of line 324 to terminal 3 on terminal board 140 and is also connected through line 326 to terminal point 300 on switch 292. Normally closed contact 320 is connected to terminal point 6 on terminal board 140 by way of line 328, while contact point 322 is connected through line 330 to terminal point 1 on terminal strip 140. Finally, manual contact 302 on switch 292 is connected by way of line 332 to terminal point 2 on strip 140.

When the master control switch 292 is in the position indicated in FIG. 2B, the control circuit operates in the automatic mode so that the system responds automatically to a demand for heat to ignite the pilot and the main burner. To accomplish this automatic operation, when the thermostat contacts close, a positive voltage is applied from supply line 192 through contact 290 and blade 294 of master switch 292, through line 306, closed switch 308, line 172, the now-closed contacts of the thermostat 166, back through line 174 and the second switch blade 296 of the switch, to contact 298 and thence through line 136 to supply a positive voltage to the pilot solenoid control circuit 134.

The positive voltage applied to the pilot solenoid control circuit 134 is applied by way of resistor 334 to the base of transistor Q3, biasing that transistor on. The collector of Q3 is connected to the positive supply line 192, while its emitter is connected by way of bias resistors 336 and 338 to the bases of transistors Q4 and Q5, respectively, whereby conduction of Q3 switches both Q4 and Q5 on. The collector of Q4 being connected to supply line 192 the emitter of transistor Q4 produces an output signal on line 138 which is applied by way of terminal 7 on terminal strip 140 and by way of line 340 to the pilot igniter control circuit 108 (FIG. 2C) and also by way of line 88 (FIG. 2D) to the pilot solenoid 20, thereby energizing that solenoid and activating the igniter control circuit. As previously indicated, energization of solenoid 20 opens the pilot valve and allows gas to flow to the pilot burner.

When transistor Q5 is shifted to its conductive condition the output from its collector is connected by way of line 142 to the pilot fail timer 144, this output being applied by way of bias resistor 342 to the base of transistor switch Q6. Transistor Q5's collector is also connected to supply line 192 through bias resistor 339 and its emitter connected to ground through lead 194. The collector of Q6 is connected by way of line 344 to the ground line 194 and its emitter is connected by way of resistors 346 and 348 to the positive bias line 192 by way of a manual reset switch 350. The bias supplied to the emitter of Q6 by these resistors is normally sufficient to cause Q6 to be conductive, thereby providing a short circuit path across timing capacitor 352 which is connected between the emitter of Q6 and ground. Capacitor 352 forms, with unijunction transistor Q7, a timing circuit which becomes operative upon the application of a voltage to the base of Q6 of sufficient value to cut Q6 off. This occurs when Q5 becomes conductive as described above to initiate the timing cycle for the pilot burner. When Q6 is cut off, capacitor 352 begins to charge through resistors 346 and 348, resistor 346 preferably being variable to permit adjustment of the timing cycle. When the timing capacitor charges to the "turn on" point of unijunction transistor Q7, that transistor produces a burst of pulses at base 354 until the timing capacitor has been discharged. Resistors 355 and 356 are connected between lines 192 and 194 to form a voltage divider which produces the required bias for base element 353. Resistor 357 is connected to ground lead 194 which provides a bias for base element 354.

It will be recalled that if the pilot burner ignites within the time established by the timing circuit 144, a reset signal is applied by way of line 156 to disable the timing circuit. Accordingly, line 156 is connected to the emitter of Q6 and serves to provide a short circuit across the timing capacitor 352 when the timer reset network 154 is activated. The latter network incorporates a transistor switch Q8, the base of which is connected by way of line 158, terminal 0 and line 160 to the pilot igniter control circuit 108 whereby Q8 is turned on by control circuit 108 upon ignition of the pilot burner. When Q8 becomes conductive in this manner, line 156 is connected through the collector-emitter circuit of Q8 to line 358 which, in turn, is connected to the ground reference line 194, thereby short circuiting the timing capacitor.

If the timing circuit is not reset, but completes its timing cycle and thus indicates an alarm condition, the positive pulses from base 354 of transistor Q7 are applied by way of line 360 to the gate electrode of a silicon controlled rectifier 362 which is connected between the positive line 192 through a resistor 364 to the ground reference line 194. When the SCR is gated on, the positive current flow through resistor 364 produces a bias voltage on the bases of transistors Q9 and Q10 through their corresponding base resistors 366 and 368, respectively. When transistor Q9 turns on, the positive bias voltage on line 192 is applied through its collector-emitter circuit to line 370 and thence to a pilot fail alarm lamp 372 which gives a visual indication of the alarm condition. In addition, this voltage is applied through lead 146, terminal connector 5, and lead 148 to energize the pilot fail alarm 150, which may be a suitable buzzer, bell, siren or the like. The use of SCR 362 insures that the alarm signals will remain on until manually reset by opening switch 350, since once Q7 initiates conduction of the SCR device, it remains conducting.

Transistor Q10 has its emitter connected to ground reference line 194 and its collector connected by way of line 152 to the base of transistor Q3 so that when Q10 becomes conductive upon occurrence of an alarm condition, the base of Q3 is grounded through the emitter-collector circuit of Q10, thus cutting off the pilot solenoid control circuit 134. When Q3 is cut off, the pilot control signal is removed from line 138, and solenoid 20 is deenergized to close the pilot valve 16. At the same time, the pilot igniter control circuit is turned off so that no further ignition sparks are produced at the pilot burner. Again, because of the presence of SCR 362, control circuit 134 is held off until the system is reset by opening reset switch 350.

When the pilot igniter control circuit 108 is activated by a call for ignition of the main burner, the signal produced by transistor Q4 and applied by way of lines 138 and 340 to the control circuit 108 (FIG. 2C) is fed through the coil 374 of a demand relay 376 having normally open contacts 378. Coil 374 is connected to ground line 194 by way of line 380. Energization of the demand relay coil 374 closes contacts 378 to complete a circuit from the positive bias supply line 192, through lead 382 to the movable arm 384 of an ignition sensing relay 386. This relay is energized in the absence of a pilot flame, so the circuit continues through the normally open (but now closed) contact 388 of relay 386 to provide a positive bias voltage to line 390 of a pulse producing circuit 392.

Pulse circuit 392 comprises a unijunction transistor Q11 having an emitter 394 connected to the junction of a resistor 396 and a timing capacitor 398 which are connected between bias line 390 and ground line 194 to form an RC timing network. One base of Q11 being connected to positive supply line 390 through resistor $R_1$ and to ground lead 194 through resistor $R_2$ to establish the turn-on level of Q11. When switch contacts 378 are closed by a demand signal, capacitor 398 begins to charge, and when it reaches the voltage level required for conduction of Q11, that transistor will produce a pulse on its base electrode 400, which pulse is applied to the exitation coil 402 of a pulse relay 404. The output from Q11 closes normally open contacts 406 to connect the positive bias on line 390 through the igniter circuit output line 106.

The conduction of Q11 discharges capacitor 398, causing Q11 to turn off. The capacitor again charges and the cycle is repeated. The alternate charging and discharging of capacitor 398 causes transistor Q11 to alternately conduct and be cut off, thereby opening and closing contacts 406 at a rate which is fixed by the values of resistor 396 and capacitor 398. Preferably, the transistor operates at a pulse rate of one pulse per second so that the positive bias voltage appears as a pulse on line 106 having that selected rate. This pulse is delivered to coil 102 which operates the piezoelectric spark generator 96 to thereby produce an ignition current on line 116 and a spark at igniter 22 (see FIG. 2D). Thus, when heat is called for by the thermostat 166, and the system is in the automatic mode, the pulse circuit 392 is activated to produce a series of pulses which operate the spark generator. If the pilot burner is not ignited within the time set by the fail timer 144, the igniter will be disabled by the removal of the voltage on line 340 in the manner previously described.

If the pilot burner is ignited by the operation of the spark igniter, the pilot generator 24 will be heated and will produce an outut on line 118 (FIG. 2D) which will be fed by way of terminal board connection 3 (FIG. 2B) through line 324 to the now-energized relay 316 to line 330 and thence back through terminal 1 on terminal strip 140 by way of line 124 (FIG. 2D) through thermistor 28 and line 126 to activate solenoid 130 and turn on the main valve 10 so that gas can flow to the main burner 12 and be ignited by the pilot. The thermistor 28 is an added safety device to insure that the main valve will not open until the pilot is ignited.

Thermistor 26 (FIG. 2C) is located near the pilot flame, and when heated by the presence of such a flame will change its resistance value. This thermistor is connected in a bridge circuit 408 having a first pair of diagonal terminal points connected across supply and ground reference lines 192, 194 and having a second pair of diagonal terminals connected across a coil 410 which forms a part of a pilot relay 412. When the pilot flame is ignited, the value of thermistor 26 will change to produce an output across coil 410 which will open the normally closed switch contacts 414. This switch normally connects line 192 to ground line 194 by way of lines 416, 418 and coil 420 of the ignition sensing relay 386, whereby coil 420 normally is energized to hold switch blade 384 in contact with contact 388 so that the pulse circuit 392 will be activated.

When thermistor 26 indicates that the pilot flame has ignited, contact 414 is opened to deenergize relay 386 and cut off the pulse circuit 392. This also causes switch element 384 to shift to its contact 422, thereby applying the positive bias voltage from line 192 through contacts 378, line 382, contact 384 and contact 422 to line 160 through current limiting resistor $R_3$. This line is connected through terminal 0 of terminal strip 140 (FIG. 2B) and thence through line 158 to the timer reset 154, the positive voltage holding transistor Q8 off and preventing the occurrence of an alarm signal. In this way, the ignition cycle is stopped, and the alarm timer is turned off.

The auxiliary temperature sensor 168 illustrated in FIG. 2C is included as an example of another demand circuit that could be used in conjunction with the present control system. This circuit which represents a water heater sensing circuit, is responsive to a temperature sensitive device such as thermistor 180 which is connected in a bridge circuit consisting of resistors 424, 426, 428, 430 and 432, the thermistor forming one arm of the bridge circuit and variable resistor 430 setting the operating temperature of the sensor. The bridge is connected between the positive line 192 and the ground reference line 194, with the bridge output appearing at terminal 434.

When the thermistor 180 is at the desired temperature, as determined by the setting of resistor 430, the net voltage at point 434 will be 0. However, as the temperature of the thermistor deviates from the set value, the voltage at point 434, and thus the voltage at the base of transistor Q12, will change. If the temperature being sensed by the thermistor drops below the preset level, for example, the resistance of the termistor will increase and will produce an increasing negative voltage at the base of transistor Q12. When this voltage reaches a sufficient value, Q12 will turn on and will conduct a positive voltage from the voltage divider consisting of resistors 436, 438, and diode 440 connected between lines 192 and 914, by way of variable resistor 442 and through the emitter-collector circuit of Q12 to the base of transistor switch Q13. This latter transistor then becomes conductive and feeds a positive voltage from 192 through collector resistor $R_4$ to exitation coil 446 of a thermal relay 448, shifting the normally open contacts 450 to the closed position to complete a circuit between lines 182 and 184 which are connected to terminals 8 and 9 of therminal strip 140. Thus, the thermal relay 448 serves to activate the appliance control circuit 132 in the same manner as thermostat 166, initiating the ignition cycle previously described in response to a detected low temperature.

Resistors 436, 438 and 442 together with a diode 440 form a bias network which affects the operating characteristics of transistor Q12. Diode 440 also provides temperature compensation for the circuit. Resistor 442 is variable and cooperates with variable resistor 430 to provide range control for the circuit. A milliammeter 452 may be connected across the bridge circuit and calibrated in degrees in order to display the measured temperature.

Transistors Q14 and Q15 form a thermistor fail circuit responsive to the condition of thermistor 180. As long as the thermistor is intact, a voltage will appear at point 434 which will be applied by way of resistor 452 to the base of transistor Q14, holding Q14 in its conductive, or "on" condition. As long as Q14 is conductive, it will maintain ground potential at the junction of bias resistors 454 and 456 at the base of transistor Q15, holding that transistor off. However, if the thermistor fails, the voltage will disappear from point 434, transistor Q14 will turn off, and a positive bias will be established at the base of Q15, turning that transistor on and conducting a positive voltage from the bias line 192 to a thermistor-fail lamp 458 which may, for example, be amber in color to provide a warning of the failure. Q14's emitter is connected to ground lead 194. Transistor Q15 is also connected through diode 460 and line 462 to the alarm bell 150, thus sounding an alarm when the thermistor fails.

The system thus far described is suitable for use in a burner valve system which utilizes a piezoelectric ignition type device. Although the valve illustrated in FIG. 2D is particularly suited to this use, any commercially available valve utilizing this type of ignition may be substituted therefor. An example of such a conventional valve is illustrated in FIG. 4, with the interconnection of that valve with the system of the present invention being illustrated through the partial illustration of the terminal strip 140. It will be understood that FIG. 4 merely illustrates the connections of the valves to the terminal strip, and does not show the manner in which the control system is connected; however, the latter connections are illustrated in FIG. 2B.

Figure 4:
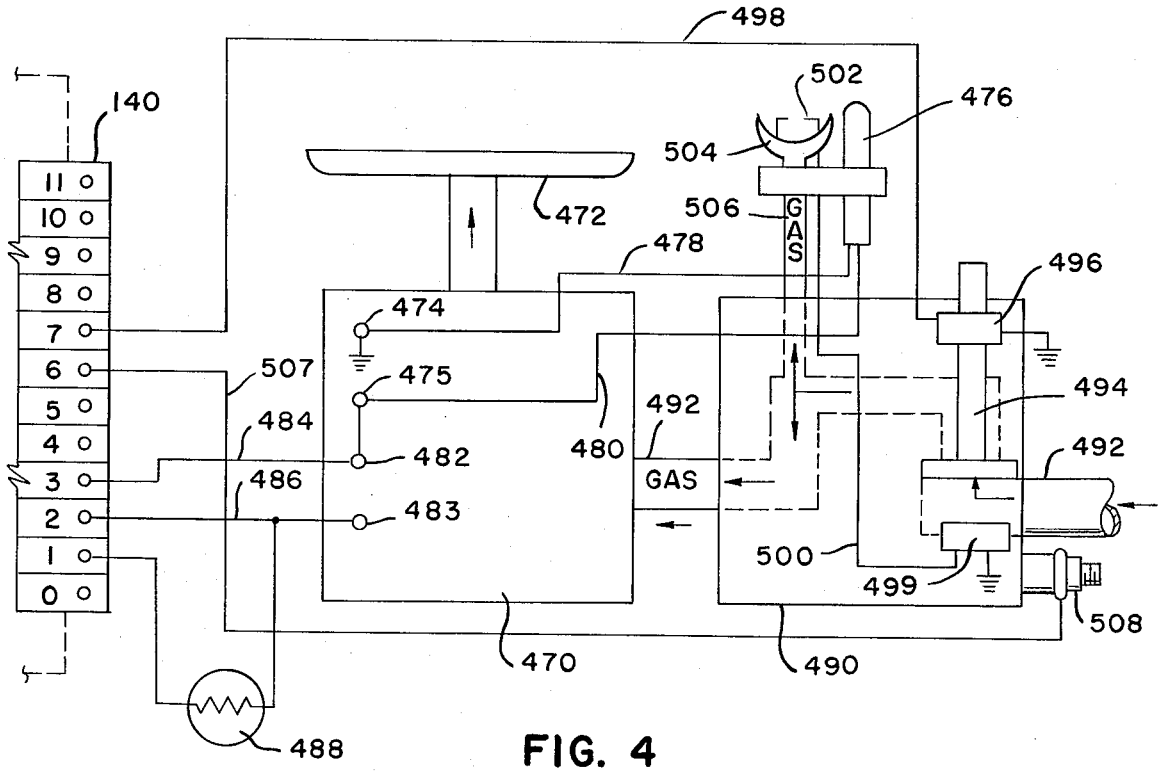
FIG. 4 illustrates in diagrammatic form a conventional valve structure utilizing a piezoelectric igniter which may be connected to the control circuit in place of the valve structure of FIG. 2D.

The unit illustrated in FIG. 4 includes a conventional main valve, such as a Model B60 Self-Powered Gas Valve available from General Controls company and described and illustrated, for example, at pages 20 and 21 of the Service Installation Manual for Residential/-Commerical Heating and Air Conditioning, published by General Controls ITT. This valve includes a solenoid-operated diaphragm valve which controls the flow of gas to a main burner 472. Two sets of control terminals are provided for this valve, terminals 474, 475 receiving the input signals from a pilot generator 476 by way of lines 478 and 480, and terminals 482 and 483 being adapted to receive input signals from a suitable thermostat. In this case, the thermostat is the control system of the present invention, and terminals 482 and 483 are connected to the control system by way of lines 484 and 486, respectively, to terminal strip connections 3 and 2, respectively. As was explained with respect to FIG. 2, terminal 2 is connected to the manual contact 302 of switch 292, while terminal 3 is connected through relay 316, which is energized when the system is in the automatic mode, back to terminal 1, which in turn is connected through thermistor 488 to terminal 483. Thermistor 488 is located at the pilot flame and is provided as a safety factor to insure that there is a flame at the pilot burner before the main valve is opened.

A conventional pilot valve 490 is associated with the main valve 470 and in the illustrated arrangement is located upstream in the gas line 492 to regulate the flow of gas to the main valve 470. The pilot includes a solenoid-operated valve 494 interposed in gas line 492 and operated by means of coil 496 by way of line 498, which is connected through terminal 7 of terminal strip 140 to the pilot solenoid control network 134. Associated with valve 494 is a piezoelectric spark generator 498 which is activated by the motion of valve 494 to produce a current on line 500. This current is applied through a spark igniter 502 which takes the form of a pair of electrodes located adjacent a pilot burner 504. The pilot burner is connected to the main gas line 492 by a branch gas line 506, the main gas line leading to the main valve 470. Terminal 6 is connected by way of line 507 to a thermal magnet 508 which, when activated, holds the pilot valve open.

The valve of FIG. 4 operates in substantially the same manner as the valve illustrated in FIG. 2D. Thus, when the thermostat 166 or the temperature sensor network 168 calls for a heating flame, the applicance control circuit 132, when switched to the automatic mode, supplies a positive voltage to the pilot solenoid control network 134 which, in turn, produces an output on line 138 which is fed by way of line 498 to solenoid 496, thus opening valve 494 and activating the spark generator 499 to ignite the gas at the burner 504. When the gas ignites, pilot generator 476 produces an output on line 480 which is fed through line 484, terminal 3, line 324, relay 316, and, since the system is set for automatic control, line 330, terminal 1, safety termistor 488 and back to terminal 483. The voltage across terminals 474, 475 due to the pilot generator and the voltage across terminals 482, 483 and serve to open the main valve and hold it open so that the main burner is ignited. It will be seen that this particular valve igniter arrangement does not require the use of the pulse generator 392 located in the pilot igniter control circuit of FIGS. 1 and 2C, but is a one-shot operation. If the spark fails to ignite the pilot, the pilot fail timer 144 will time out and turn off the control circuit 134 so that the system will have to be reset.

Figure 5:
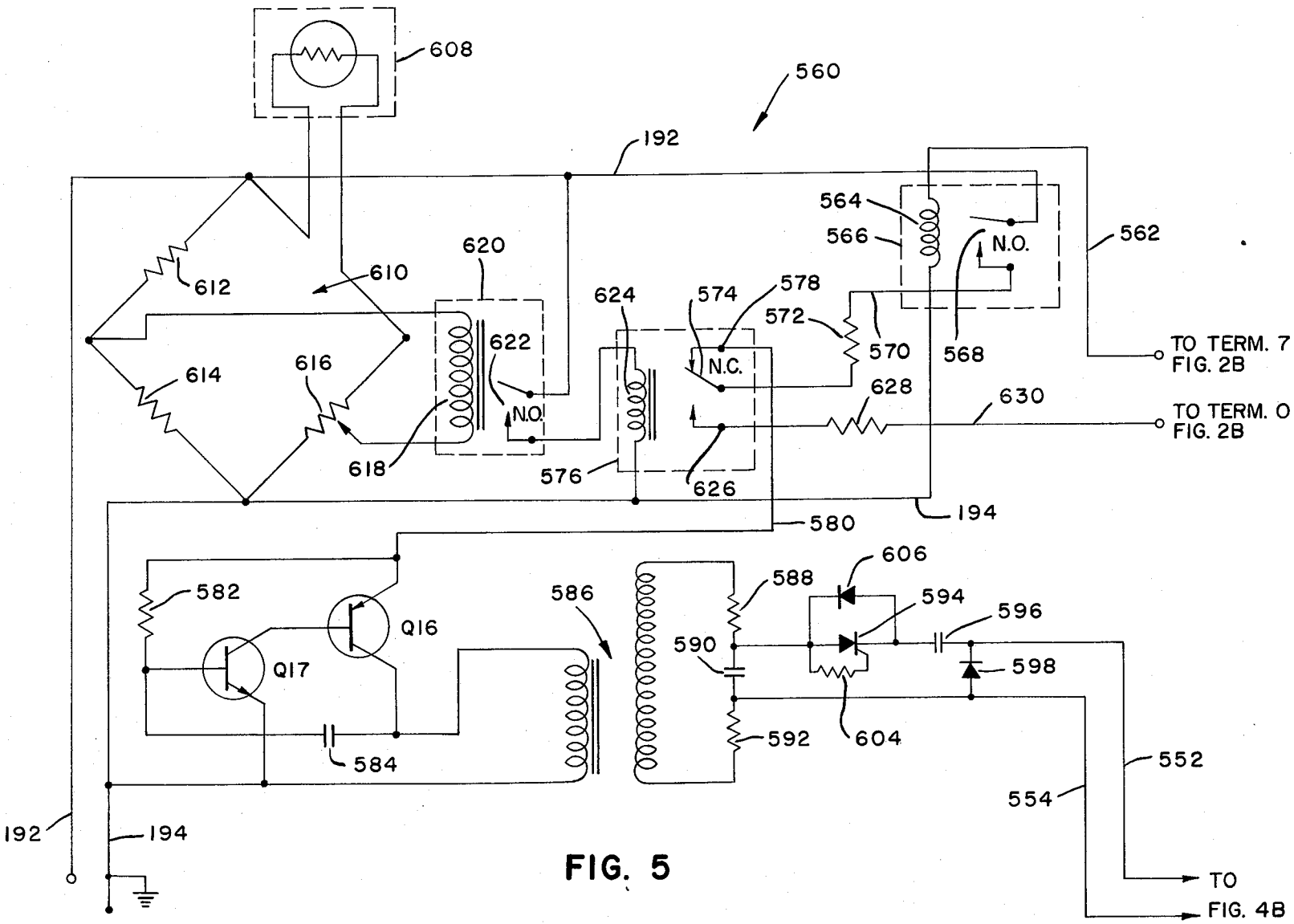
FIG. 5 is a schematic diagram of a multivibrator form of the igniter control circuit of FIG. 2C and which is used with units requiring a multivibrator source.

The present control system is also useable with the "multivibrator" type of ignition system utilizing the oscillator ignition circuit of FIG. 5 in place of the igniter control circuit 108 illustrated in FIG. 2C. This multivibrator circuit is used in conjunction with a valve such as that illustrated in FIG. 6. The main valve 510 illustrated in this figure may, for example, be a model B60 of the type available from General Controls ITT, as described in the Service Installation Manual provided by that company and entitled "Residential/Commercial Heating and Air Conditioning." This valve includes a main burner 512, a first pair of control terminals 513 and 514 connected to a pilot generator 516 by way of lines 518 and 520. A second pair of control terminals 522 and 523 are provided, terminal 522 being connected to terminal 514 by a jumper 524. Terminal 522 is also connected by way of line 526 to terminal 3 on the terminal strip 140 and thence through the control relay 316 (FIG. 2B) and terminal 1, through lines 528 and 530, thermistor 532 and line 534 to terminal 523.

Associated with valve 510 is a pilot valve which incorporates a solenoid-operated valve 540 driven by solenoid coil 542 and its associated armature 544. The coil 542 is driven by current applied from the control circuit 134 by way of line 138, terminal 7 on the strip 140, and line 546. When the coil 542 is energized to open valve 540 and supply gas from the main gas line 492 to the main valve 510, some of the gas is fed through branch line 548 to the pilot burner 550. At the same time, the multivibrator circuit illustrated in FIG. 5, and described below, produces on lines 552 and 554 an ignition current which is fed through stepup transformer 556 to a spark igniter 557. This spark continues until the pilot burner is ignited, at which time the main burner valve 510 is opened, or until the pilot fail timer 144 times out. Terminal 6 of strip 410 is connected by way of line 558 to a thermal magnet 559 which, when activated, holds the valve 540 open. It should be noted that thermal magnet 559 is energized only when switch 292 is in the manual position.

The multivibrator igniter control circuit 560 of FIG. 5 is activated by the positive voltage appearing on line 138 and terminal 7 when the control system is calling for operation of the gas valve. This signal, which is the same one that operates the pilot solenoid, is applied by way of line 562 to one side of an exitation coil 564 of a demand relay 566 having normally open contacts 568, the other side of coil 564 being connected to ground reference line 194. When demand relay 566 is energized, contacts 568 are closed to supply the positive bias voltage from line 192 through line 570 and current limiting resistor 572 to the movable contact arm 574 of ignition sensing relay 576. Arm 574 normally closes contact 578 to supply this positive voltage through line 580 to the emitter of a multivibrator transistor Q16 and through base bias resistor 582 to the base of a second multivibrator transistor Q17.

The base of transistor Q17 is connected through capacitor 584 to the collector of transistor Q16, with the primary winding of a transformer 586 being connected across the collector and emitter of transistors Q16 and Q17, respectively, the emitter of Q17 being grounded. Q16's base is connected to Q17's collector and transistors Q16 and Q17 thus are connected in conventional multivibrator configuration, producing an alternating current across transformer 586 when a positive bias voltage appears on line 580. The alternating current appearing on the secondary of transformer 586 is in the form of a pulsed direct current at a frequency of about 10 kHz, stepped up from the low voltage output of the multivibrator to about 150 volts by the high turns ratio of transformer 586. Connected across the secondary is the series arrangement of resistor 588, capacitor 590 and resistor 592 which form a voltage doubler and wave shaping network, with capacitor 590 also providing some filtering as well as some loading for transformer 586. The output derived from the junction of resistor 588 and capacitor 592 is applied through SCR 594, capacitor 596 and across diode 598 to output lines 552 and 554, the SCR rectifying the output pulses from transformer 586. The positive pulses from the junction of resistor 588 and capacitor 590 are also fed through resistor 604 to the gate of the SCR 594, turning it on. As the pulse falls to 0, the SCR is turned off, this cut-off being assisted by reversely connected diode 606. As the SCR turns off, current to the output lines 552 and 554, which are connected in FIG. 6 to the primary of pulse coil 556, is interrupted, causing a collapse in the magnetic flux in the primary of the pulse coil. This induces about 6,000 to 8,000 volts across the secondary of the pulse coil which is sufficient to produce an arc across the sparking gap 557, thereby igniting the gas flow at the pilot burner 550. Capacitor 596 provides filtering and isolation from the primary of the pulse coil 556.

A thermistor 608 is located at the pilot burner and is connected in a bridge circuit 610 consisting of resistors 612 and 614 and variable resistor 616, the bridge being connected across lines 192 and 194. The output of the bridge varies in accordance with the temperature sensed by the thermistor 608, the output of the bridge producing a current in coil 618 of a pilot relay 620 when the thermistor indicates the presence of a flame. This shifts the contact 622 of the relay to connect the energization coil 624 of ignition sensing relay 576 across the bias lines 192, 194, thereby activating relay 576 and shifting its movable contact 574. This removes the positive bias from line 580 and shuts down the multivibrator circuit, while at the same time placing a positive bias on terminal 626, which is applied by way of current limiting resistor 628 through line 630 to terminal 0 of terminal strip 140, this signal serving to reset the alarm timing sequence.

Although the main thrust of the discussion of the invention in its various embodiments and forms has been directed to the automatic operation of the system, the manual setting of the control system is also important in that it provides another dimension of operation for the system. Thus, returning for the moment to a consideration of the embodiment of FIG. 2, it will be seen that when switch 292 (FIG. 2B) is placed in the manual position, the thermostat 166 will be connected by way of terminal 9 and line 174 through the switch contacts 296, 302 and line 332 to terminal connection 2.

This connection leads through line 124 and thermistor 28 to the main valve solenoid 130 so that when the thermostat calls for operation of the system, the main gas valve is opened.

To manually operate the system illustrated in FIG. 2, the switch 292 is shifted to its manual position to close contacts 300 and 302. The pilot light is then ignited by manually depressing pilot valve 16 and manually operating the piezoelectric igniter 396. When the pilot flame has been ignited, the generator 24 produces an output current on line 118 which is applied by way of terminal 3 to line 324, through relay contacts 318, 320 to line 328 and thence through terminal 6 and line 88 (FIG. 2D) to the pilot solenoid 20. The generator 24 thus activates the solenoid 20 to hold pilot valve 16 open as long as there is a pilot flame, and, accordingly, in the manual mode there is a continuous pilot flame. The main burner then operates under the control of thermostat 166, the closure of the thermostat applying the voltage from the generator 24 by way of line 324, line 326, switch contact 294, line 306, line 172, through the thermostat contacts to line 178, through line 174 to the manual switch contact 296 and its terminal 302, through line 332 back to terminal 2 on strip 140 and thence by way of line 124 (FIG. 2D) through safety thermistor 28 and line 126 to the main valve solenoid 130. Whenever the thermostat closes, solenoid 130 is activated to open the main valve and allow the main burner to go on. Thus, in the manual mode, the pilot burns continuously, and only the main valve opens and closes in response to the thermostat.

When the burner of FIG. 4 is used in the manual mode with the control system of the present invention, pilot valve 494 is depressed manually to open the pilot gas line and to cause the piezoelectric element 494 to produce a spark at the pilot burner. When the pilot has been ignited, generator 476 produces a current on line 480 which is applied by way of line 484 and terminal 3 of strip 140 through line 324 and relay 316 back through line 328 and terminal 6 and through line 507 to the thermal magnet 508 which holds the pilot valve open. Thus, once the pilot burner is manually ignited, the thermal magnet 508 holds it open and keeps the pilot flame on. Thereafter, the thermostat 166 will control the operation of the main burner in the usual manner by way of terminal 2 on the terminal strip 140. The valve of FIG. 6 operates essentially in the same manner, with pilot valve 540 being held open by thermal magnet 506 by means of a signal applied by way of line 520 from the pilot generator 516. Again, after the pilot has been ignited, it burns continuously, and only the main valve opens and closes in response to the operation of the thermostat. In either valve, if the pilot should be extinguished, the generator 476 or 516 will produce no current, and the thermal magnet 508 or 559 will release the valve to close off the gas flow to the pilot burner.

Although the foregoing description has been in terms of controlling a single valve by means of the system of the present invention, it will be apparent that a plurality of valves can be connected in the present system, using various components thereof, such as the multivibrator or the pulse generator, the alarm system, and the like, in common, but with separate elements as required by the particular valve arrangements used.

Thus there has been disclosed a new and unique control system for use with a fuel burner which permits automatic control of the burner and its pilot. The control system has an automatic mode wherein the pilot burner is shut down after each operation of the main burner and wherein the system automatically restarts both the pilot and the main burner when there is a demand for additional heat. The control system also has a manual mode which allows the pilot light to remain on and which causes the main burner to cycle with the demand of the thermostat. In the automatic mode, the pilot burner is ignited automatically by ignition sparks produced either by piezoelectric devices or by a multivibrator circuit, while in the manual mode, the pilot is ignited by manual operation of the pilot valve. Although the invention has been described in terms of specific embodiments thereof, it will be understood that numerous variations may be made without departing from the true spirit and scope thereof as set forth in the following claims:

We claim:

1. A centralized automatic pilot/pilotless ignition control system for controlling a combustible fuel burning appliance from a location remote from said appliance, said appliance being equipped with a main fuel supply valve connected to a source of fuel, a main burner connected through said main fuel supply valve to said source of fuel, a pilot burner for said main burner, said pilot burner being connected through a pilot valve to said source of fuel, and an electrically energized fuel igniter operatively associated with said pilot burner, said control system comprising:

temperature sensing means for regulating the operation of said appliance, said temperature sensing means being operative to call for an ignition and maintenance of a flame at said main burner;

first circuit means remote from said appliance and responsive to said temperature sensing means to activate said pilot valve to permit a flow of fuel to said pilot burner;

second circuit means remote from said appliance and responsive to said temperature sensing means to start an automatic ignition cycle for producing a flame at said pilot burner, said second circuit means including means to activate said electrically energized fuel igniter;

alarm timing means remote from said appliance and responsive to the start of said ignition cycle to produce an alarm if no pilot flame occurs within a predetermined time;

pilot generator means responsive to a pilot flame to reset said alarm timing means;

third circuit means remote from said appliance and responsive to said pilot generator to open said main fuel supply burner upon occurrence of a pilot flame, whereby a main burner flame is produced;

manual control circuit means operable when said first and second circuit means are disabled to permit manual operation of said pilot valve and said electrically energized igniter; and switch means for enabling said manual control circuit means and disabling said first and second circuit means.

2. The combination according to claim 1, in which said temperature sensing means includes a thermostat operative to make and break a circuit in response to fluctuations in ambient temperature sensed by said thermostat.

3. The combination according to claim 1, in which said temperature sensing means includes an electronic temperature sensor adapted for use with a water heater and operative to make and break a circuit in response to fluctuations in the temperature of water in which the sensor is immersed.

4. The combination according to claim 1, in which said control system further includes an electric switch for use in conjunction with a range so as to automatically complete a circuit through said switch upon demand for heat.

5. The combination of claim 1, further including a pilot valve control solenoid, said first circuit means including a solenoid control circuit operatively connected to said pilot control solenoid.

6. The combination according to claim 1, in which said alarm timing means responds to the failure of the pilot burner to ignite to produce an alarm signal and to shut said pilot valve of said pilot burner is not ignited within said predetermined time.

7. The combination according to claim 1, in which said fuel igniter comprises a piezoelectric crystal for generating a surge of electric current upon demand, and a spark gap across which said current jumps to form an arc for igniting fuel at said pilot burner.

8. The combination according to claim 1, in which said means to activate said fuel igniter comprises a multivibrator, the output from which is connected to said igniter for igniting the fuel at said pilot burner.

9. The automatic control system of claim 1, wherein said igniter includes spark gap means adjacent said pilot burner, and wherein said second circuit means comprises a free-running multivibrator adapted to produce an alternating current output signal, means for stepping up the voltage of said output signal, and means for applying said stepped-up voltage across said spark gap to produce a spark which will ignite fuel at said pilot burner.

10. The automatic control system of claim 9, further including circuit means responsive to the production of a flame at said main burner to turn off said multivibrator.

11. The automatic control system of claim 1, wherein said igniter includes spark gap means adjacent said pilot burner, and wherein said second circuit means comprises a piezoelectric device responsive to the opening of said pilot valve to produce an electric current, and means for applying said current to said spark gap to produce a spark which will ignite fuel at said pilot burner.

12. The automatic control system of claim 1, wherein said main fuel supply valve comprises:

a housing;

a main inlet chamber connected to a source of fuel and a main outlet chamber connected to said main burner within said housing;

a diaphragm valve mounted in said housing and separating said inlet chamber from said outlet chamber;

a diaphragm control chamber within said housing adjacent said diaphragm valve;

a first passageway feeding fuel from said inlet chamber to said diaphragm control chamber, whereby the pressure of said fuel normally holds said diaphragm valve closed to prevent flow of fuel to said outlet chamber;

a pilot chamber within said housing;

a second passageway feeding fuel from said inlet chamber to said pilot chamber, whereby fuel under pressure is maintained in said pilot chamber;

a third passageway feeding fuel from said pilot chamber to said pilot burner, said pilot valve normally closing said third passageway;

a fourth passageway leading from said diaphragm control chamber to said pilot chamber; and a diaphragm control valve normally closing said fourth passageway.

13. The automatic control system of claim 12, wherein said pilot valve is responsive to said first circuit means to open said third passageway and close said second passageway, whereby fuel from said pilot chamber flows to said pilot burner for ignition.

14. The automatic control system of claim 13, wherein said diaphragm control valve is responsive to said third circuit means to open said fourth passageway and close said first passageway to bleed the fuel in said diaphragm control chamber into said pilot chamber to maintain the pilot flame and to relieve the pressure of fuel in said diaphragm control chamber, thereby allowing said diaphragm valve to open and allowing fuel to flow from said inlet chamber to said outlet chamber and thence to said main burner.

15. The automatic control system of claim 14, wherein said igniter comprises a spark gap adjacent said pilot burner and a piezoelectric device mounted on said housing for supplying an electric current to said spark gap, and wherein said second circuit means activates said piezoelectric device periodically to supply current pulses to said spark gap.

16. The automatic control system of claim 15, wherein said second circuit means comprises a pulse circuit responsive to said temperature sensing means to produce a series of timed pulses, and temperature sensing means responsive to the presence of a pilot flame to disable said pulsing circuit and to disable said alarm timing means.

17. The automatic control system of claim 16, wherein said alarm timing means comprises a timer circuit which is activated upon activation of said pulse circuit, said timer circuit having a predetermined, adjustable period before it times out; an alarm circuit responsive to said timer circuit to produce an alarm signal when said timing circuit times out; and reset means for disabling said timer circuit upon occurrence of a pilot flame.

18. The automatic control system of claim 17, further including means for manually activating said pilot valve and said piezoelectric device to produce a pilot flame, and means responsive to said manual control circuit for holding said pilot valve open to maintain said pilot flame when said control system is in a manual mode, said diaphragm valve thereupon operating in response to said temperature sensing means to turn said main burner on and off.

19. The automatic control system of claim 1, further including a source of electromotive power connected to said system.

20. The combination according to claim 19, in which said electromotive power source comprises a source of alternating current power.

21. The combination according to claim 19, in which said electromotive power source comprises a battery as a source of DC power.

22. The combination according to claim 19, in which said electromotive power source comprises a source of alternating current, and a DC regulated power supply operatively associated therewith.

23. The combination according to claim 19, in which said electromotive power source comprises a source of alternating current, a DC regulated power supply operatively associated therewith, and a battery connected to said regulated power supply to receive a "trickle" charge therefrom, said battery being connected to said system to supply power thereto upon failure of said source of alternating current power.

* * * * *